US006871568B2

(12) United States Patent
Chen

(10) Patent No.: US 6,871,568 B2
(45) Date of Patent: Mar. 29, 2005

(54) HAND-HELD FRAMING TOOL

(76) Inventor: Chung-Wu Chen, No. 64-2, Chiu Sheh Lane, Chiu Sheh, Pei Tun Area, Taichung (TW)

( * ) Notice: Subject to any disclaimer, the term of this patent is extended or adjusted under 35 U.S.C. 154(b) by 0 days.

(21) Appl. No.: 10/414,006

(22) Filed: Apr. 16, 2003

(65) Prior Publication Data

US 2004/0206209 A1 Oct. 21, 2004

(51) Int. Cl.[7] ..... B25C 3/00
(52) U.S. Cl. ..... 81/44; 227/113; 227/147
(58) Field of Search ..... 81/44, 23; 227/113, 227/147; 29/275

(56) References Cited

U.S. PATENT DOCUMENTS 913,014 A * 2/1909 Kafer ..... 227/147
1,699,519 A * 1/1929 Brown ..... 227/147
2,430,532 A * 11/1947 Rayburn ..... 227/147
3,788,537 A * 1/1974 Fox ..... 227/147
4,061,225 A * 12/1977 Pettitt ..... 227/147
4,316,513 A * 2/1982 Harris ..... 227/113
4,834,342 A * 5/1989 Padgett ..... 227/147
5,605,271 A * 2/1997 Russell ..... 227/147
6,220,121 B1 4/2001 Leete
6,585,142 B1 * 7/2003 Chen ..... 227/113

* cited by examiner

*Primary Examiner*—James G. Smith
(74) *Attorney, Agent, or Firm*—Browdy and Neimark, P.L.L.C.

(57) ABSTRACT

A hand-held framing tool includes a handle, a cover shell, and a guide member. The handle includes a coupling portion at an end thereof and a bar member protruded outwards from the coupling portion and fitted with a spring. The cover shell includes a chamber inside at a front end thereof and a guide hole positioned at a bottom side of the chamber. The guide member includes a stopping portion at an end thereof and a plurality of guide ditches extended longitudinally along an inner periphery of a hollow space thereof. The guide member is fitted in the guide hole of the cover shell. The bar member of the handle runs through the hollow space of the guide member. The spring contacts against the stopping portion of the guide member at an end thereof and contacts against the coupling portion of the handle at the other end thereof.

7 Claims, 6 Drawing Sheets

HAND-HELD FRAMING TOOL

BACKGROUND OF THE INVENTION

1. Field of the Invention

The present invention relates generally to hand-held tools, and more particularly to a hand-held framing tool for inserting nails into picture frames or the like.

2. Description of the Related Art

As shown in FIG. 1, while making a picture frame regularly, a V-shaped nail C is inserted into between two adjacent frame bars A and B by a hand-held framing tool. A conventional hand-held framing tool, as disclosed in U.S. Pat. No. 6,220,121, includes a tool body, an anvil head, and means for retaining fasteners. The retaining means is a magnet to hold the V-shaped nail at a front end thereof. While the framing tool is punched to drive the nail to contact against the two frame bars of the picture frame, the retaining means will retract in the anvil head and against biasing means to permit the anvil head to drive the nail into the frame's surface, thereby securing the two frame bars of the frame.

However, there are some drawbacks for the aforementioned conventional framing tool. The retaining means holds the nail merely by magnetism thereof without any other retaining force such that while the framing tool is held not vertical to the frame or the nail is positioned beveledly, the nail may be squashed on the surface of the frame even projected outwards to hurt someone rather than inserted into the frame.

SUMMARY OF THE INVENTION

The primary objective of the present invention is to provide a hand-held framing tool, which is structurally simple, and easy and safe for operation.

The foregoing objective of the present invention is attained by the hand-held framing tool, which is composed of a handle, a cover shell, and a guide member. The handle includes a coupling portion at an end thereof and a bar member protruded outwards from the coupling portion and fitted with a spring. The cover shell includes a chamber inside at a front end thereof and a guide hole positioned at a bottom side of the chamber, running through a rear end thereof, communicating with the chamber, and having a smaller inner diameter than the chamber. The cover shell is connected with the coupling portion of the handle. The bar member has a distal end extended slightly out of the cover shell. The guide member is an elongated tube member and includes a stopping portion at an end thereof and a plurality of guide ditches extended longitudinally along an inner periphery thereof. The guide member is fitted in the guide hole of the cover shell and the bar member of the handle runs through a hollow space thereof, so as to receive the bar member inside. The spring contacts against the stopping portion of the guide member at an end thereof and contacts against the coupling portion of the handle at the other end thereof.

DETAILED DESCRIPTION OF THE INVENTION

Figure 1:
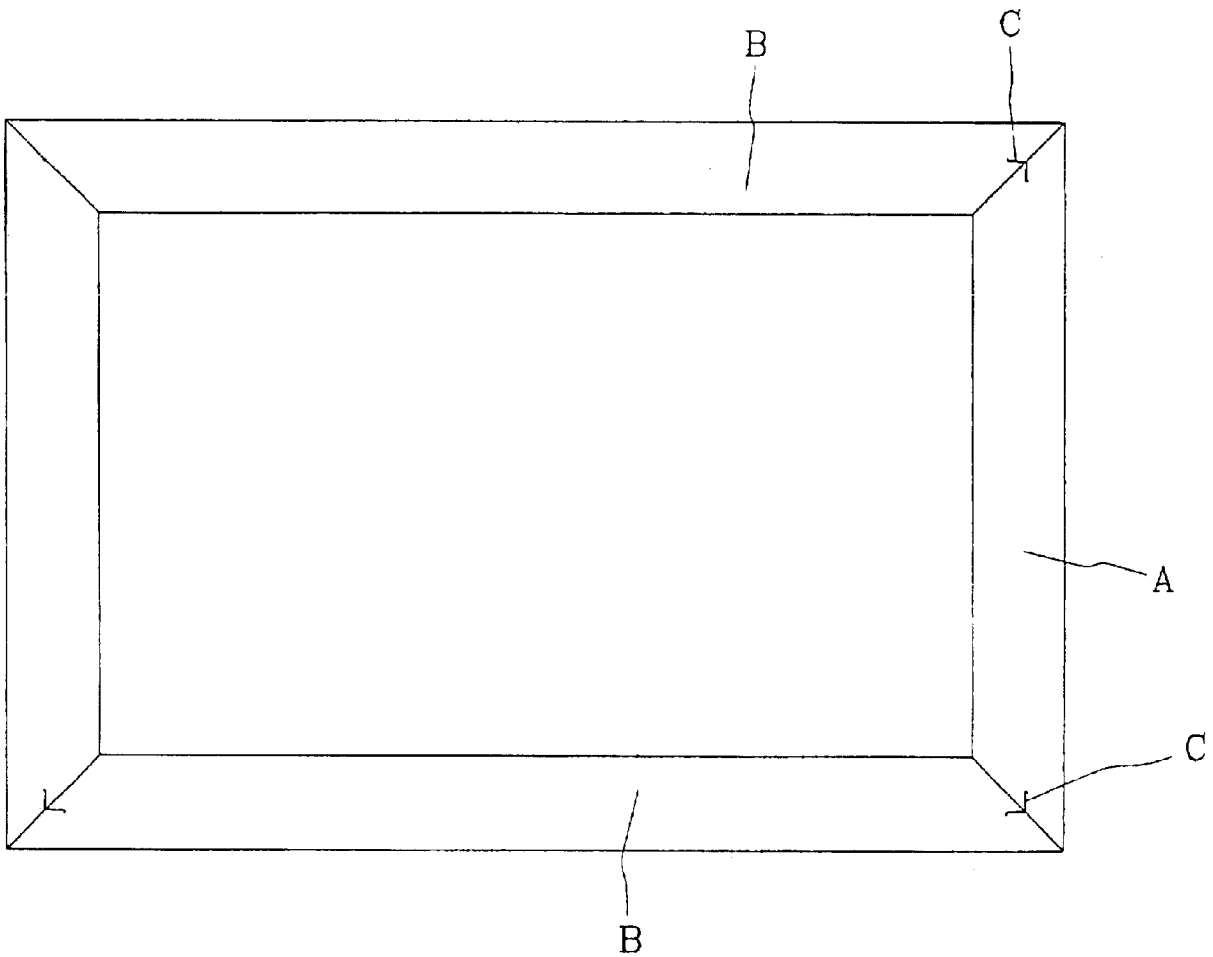
FIG. 1 is a schematic view of a picture frame where V-shaped nails are inserted.
Figure 2:
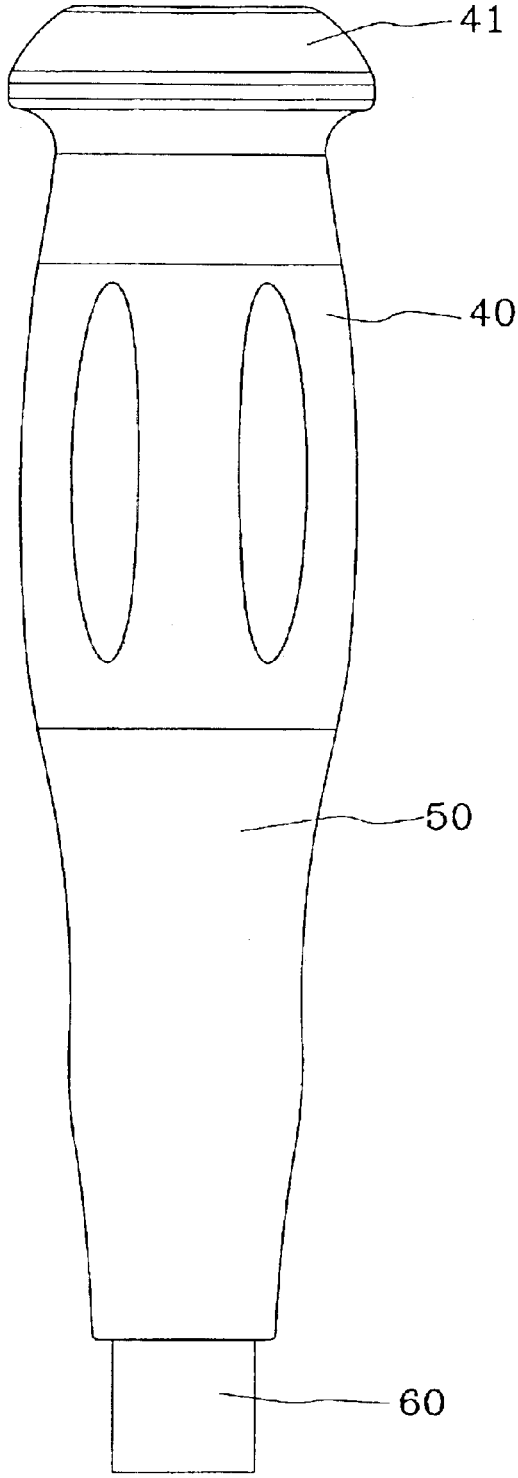
FIG. 2 is an elevational view of a preferred embodiment of the present invention.
Figure 3:
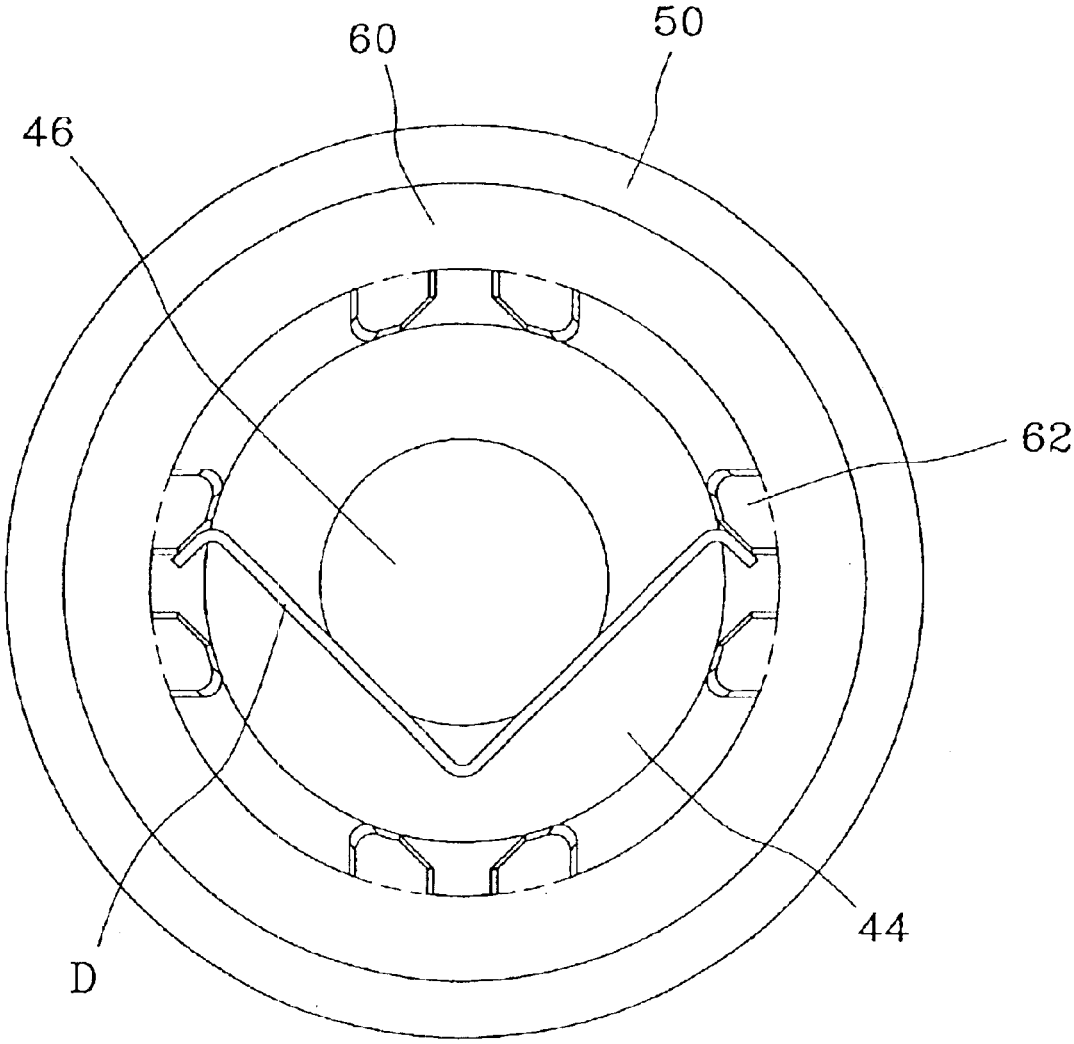
FIG. 3 is a bottom view of the preferred embodiment of the present invention.
Figure 4:
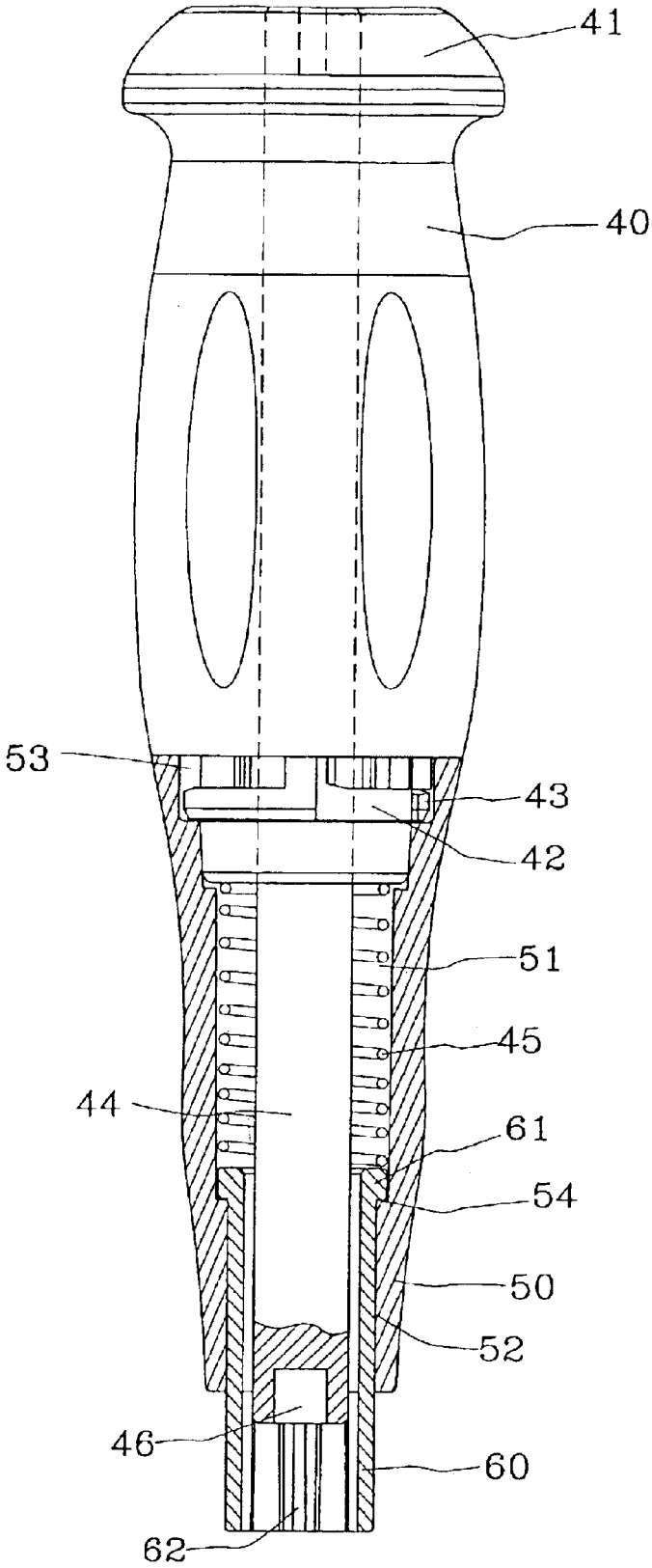
FIG. 4 is a partial sectional view of the preferred embodiment of the present invention.

Referring to FIGS. 3–4, a hand-held framing tool of the present invention is composed of a handle 40, a cover shell 50, and a guide member 60.

The handle 40 is cylindrical and includes a convex portion 41 at an end thereof and a coupling portion 42 at the other end thereof. The coupling portion 42 is provided with a thread 43 at an outer periphery thereof and a bar member 44 protruded outwards from the coupling portion 42. The bar member 44 is fitted with a spring 45 and is provided with a magnet 46 at a free end thereof.

The cover shell 50 is taper-like, including a wide end where a chamber 51 is formed inside, a thin end where a guide hole 52 is formed and positioned at a bottom side of the chamber 51, and a stepped portion 54 formed between the chamber 51 and the guide hole 52. The guide hole 52 has a smaller inner diameter than the chamber 51 and communicates with the chamber 51 and runs through the thin end of the cover shell 50. The cover shell 50 is further provided with a thread 53 at an inner periphery of the chamber 51 in proximity of the wide end of the chamber 51 for connecting the coupling portion 42 of the handle 40, such that the bar member 44 of the handle 40 is protruded slightly out of the thin end of the cover shell 50 at a distal end thereof.

The guide member 60 is an elongated tube member and includes a hollow space inside, a stopping portion 61 at an end thereof, and four ditches 62 extended longitudinally along an inner periphery thereof. The guide member 60 is fitted in the guide hole 52 of the cover shell 50 around the bar member 44 such that the bar member44 is extended through the hollow space of the guide member. The spring 45 has an end contacted against the coupling portion 42 of the handle 40 and the other end contacted against the stopping portion 61 of the guide member 60 such that the stopping portion 61 of the guide member 60 rests at the stepped portion 54 of the cover shell 50 in normal operation.

Figure 5:
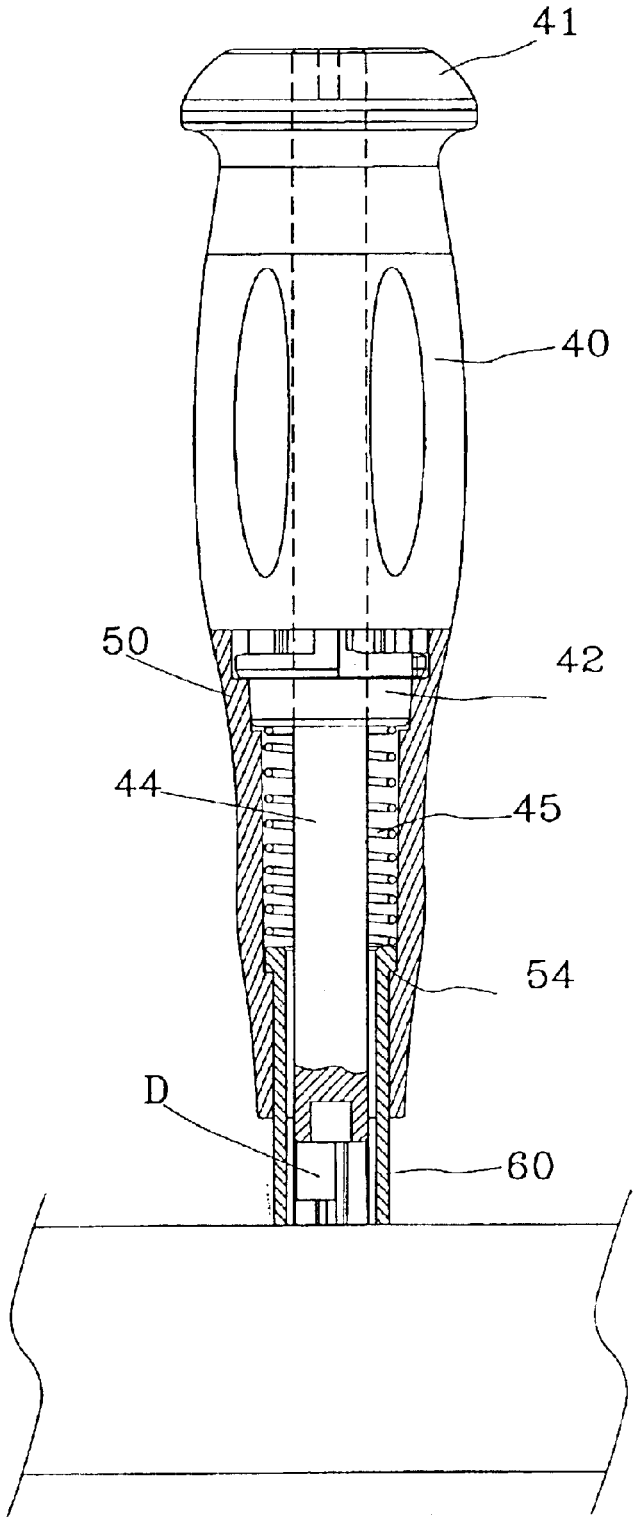
FIG. 5 is a partial sectional view of the preferred embodiment of the present invention showing that a nail is held by the guide member.
Figure 6:
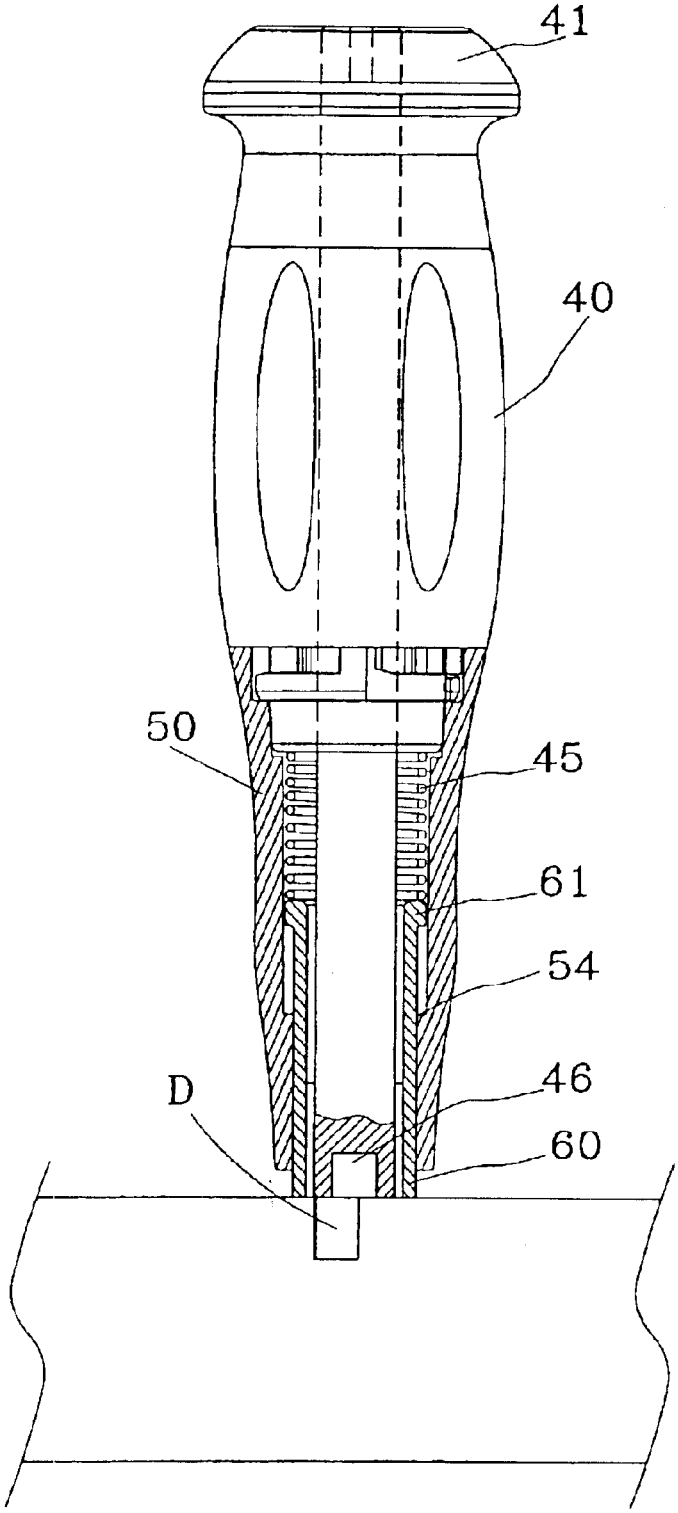
FIG. 6 is a partial sectional view of the preferred embodiment of the present invention showing that the nail is punched into the frame.

While operating the framing tool of the present invention, a V-shaped nail D is placed into the guide ditches 62 of the guide member 60 and then the user holds the handle 40 to move the framing tool to aim the nail at a corner of a picture frame. In the meantime, the V-shaped nail is positioned longitudinally straight by the guiding of the guide ditches 62 and engaged by the magnet 46 so as not to slip away, as shown in FIGS. 3 and 5. After aiming at the corner of the picture frame, punch the framing tool onto the frame. At the same time, the guide member 60 contacts the frame first and then retracts gradually inside the guide hole 52 of the cover shell 50 to squeeze the spring 45 by the stopping portion 61. When the guide member 60 retracts until the nail contacts against the frame, the frame tool is punched further towards the frame such that the nail is pushed by the bar member 44 of the handle 40 to be inserted into the corner of the frame. Meanwhile, while the user takes the framing tool away from the frame, the guide member 60 returns to its original position by the rebounding resilience of the spring 45.

Because the V-shaped nail is kept positioned longitudinally straight by the guide ditches 62 of the guide member 60 during the whole operation, the nail will not be squashed or projected outwards to hurt the user. Accordingly, the present invention is obviously safe for the user, thereby improving the prior art effectively.

What is claimed is:

1. A hand-held framing tool comprising:

a handle having a coupling portion at an end thereof and a bar member protruded outwards from said coupling portion, a spring extending along the length of said bar member;

a cover shell having a chamber and a guide hole formed at a bottom end of said chamber, said guide hole communicating with said chamber and running through a first end of said cover shell, a second end of said cover shell being connected with said coupling portion of said handle so that said bar member extends out from the first end of said cover shell;

an elongated tubular guide member having a cylindrical hollow space which has a plurality of guide ditches extending longitudinally along an inner periphery thereof at a first end of said guide member, said guide ditches being provided to engage and guide sides of a nail having a V-shaped cross-section which fixes abutting end portions of a frame together, said guide member being fitted in said guide hole of said cover shell so that said bar member of said handle runs through the hollow space of said guide member, said spring has two ends respectively contacting against a second edge of said guide member and said coupling portion, and wherein said bar member comprises a magnet at a free end thereof.

2. The hand-held framing tool as defined in claim 1, wherein said guide member comprises a stopping portion at said second end, said stopping portion having a larger outer diameter than said guide member.

3. The hand-held framing tool as defined in claim 2, wherein said guide hole has a smaller inner diameter than that of said chamber, and said cover shell further comprises a stepped portion between said chamber and said guide hole, such that said guide member can engage said stepped portion by said stopping portion.

4. The hand-held framing tool as defined in claim 2, wherein said spring contacts against between said stopping portion of said guide member and said coupling portion of said handle.

5. The hand-held framing tool as defined in claim 1, wherein said coupling portion of said handle is provided with a thread at an outer periphery thereof.

6. The hand-held framing tool as defined in claim 5, wherein said cover shell is tapered and comprises a wide end where said chamber is located and a thread positioned at an inner periphery of said wide end thereof, said cover shell being connected with said coupling portion of said handle by engagement of said thread of the cover shell with said thread of the handle.

7. The hand-held framing tool as defined in claim 1, wherein more than two guide ditches are provided around the periphery of said cylindrical hollow space.

* * * * *